United States Patent [19]

Matsumoto et al.

[11] 4,090,430

[45] May 23, 1978

[54] SWASH PLATE TYPE COMPRESSOR

[75] Inventors: Shiro Matsumoto; Jiro Shishido; Toshitsugu Fukumoto, all of Hiroshima, Japan

[73] Assignee: The Japan Steel Works, Tokyo, Japan

[21] Appl. No.: 743,979

[22] Filed: Nov. 22, 1976

Related U.S. Application Data

[63] Continuation of Ser. No. 579,445, May 21, 1975, abandoned.

[30] Foreign Application Priority Data

Oct. 9, 1974 Japan ..... 49-115478

[51] Int. Cl.[2] ..... F01B 3/02

[52] U.S. Cl. ..... 92/71; 91/507; 92/150; 92/153; 92/168; 417/269

[58] Field of Search ..... 92/12.2, 70, 71, 86, 92/150, 151, 152, 153, 168; 91/499, 507; 417/269; 74/60

[56] References Cited

U.S. PATENT DOCUMENTS

| | | | |
|---|---|---|---|
| 853,095 | 5/1907 | Lemp | 74/60 |
| 2,878,990 | 3/1959 | Zürcher | 92/153 |
| 3,304,885 | 2/1967 | Orth | 92/153 |
| 3,370,510 | 2/1968 | Bunyan | 74/60 |
| 3,538,706 | 11/1970 | Toepel | 417/269 |
| 3,572,215 | 3/1971 | Harris | 91/499 |
| 3,817,660 | 6/1974 | Knowles | 417/269 |
| 3,839,946 | 10/1974 | Paget | 92/153 |

*Primary Examiner*—Martin P. Schwadron
*Assistant Examiner*—Abraham Hershkovitz
*Attorney, Agent, or Firm*—Amster & Rothstein

[57] ABSTRACT

A swash plate type compressor to provide reciprocation of cylindrical guide members arranged around a driving shaft axis and a corresponding number of pistons respectively connected to the cylindrical guide members with lubricating means arranged in compartments to prevent leakage of lubricant to the pistons.

1 Claim, 2 Drawing Figures

SWASH PLATE TYPE COMPRESSOR

This is a continuation of application Ser. No. 579,445 filed May 21, 1975 now abandoned.

BACKGROUND OF THE INVENTION

The present invention relates to a swash plate type compressor and more particularly to a swash plate type compressor in which gas to be compressed and lubricating oil used are prevented from mixing with each other during the compressing operation in order that no oil is mixed into the compressed gas.

A swash plate type compressor, i.e. a compressor provided with a swash plate in the form of an inclined circular plate mounted to a drive shaft, has hitherto been widely used for e.g. small type refrigerator compressors, and the like but it has always had such a construction that lubricating oil used for decreasing friction and wear of the relatively reciprocating parts of the compressor is allowed to be easily mixed into the gas during its compressing process in the compressor. That is, in the conventional swash plate type compressor construction the compartment in which the swash plate rotates always containes lubricating oil in it to supply the oil to the relative sliding parts of the compressor and this compartment is directly connected to cylinders in which compression of the gas takes place by respective pistons mounted in them to be reciprocated under the action of the swash plate.

Accordingly it has been hitherto recognized to be inevitable in the conventional swash plate type compressor that the compressed gas is accompanied by the lubricating oil while it is subjected to compression in the cylinders. However, it will be apparent that such a compressed gas contaminated with lubricating oil is not appropriate for most applications, e.g. refrigeration.

SUMMARY OF THE INVENTION

It is an object of the present invention to provide a swash plate type compressor in which no contamination of compressed gas with lubricating oil is assured.

According to the swash plate type compressor of the present invention, this is achieved by the swash plate being adapted to reciprocate a number of cylindrical guide members which are respectively slidably disposed in cylindrical guide blocks that are arranged around the axis of the driving shaft in parallel therewith to drive the swash plate and a corresponding number of pistons which are disposed within respective cylinders that are arranged around the axis of the driving shaft and yet separated from the cylindrical guide blocks being connected to the respective cylindrical guide members through respective connecting rods, whereby the pistons compress the gas in association with the cylinders upon rotation of the swash plate without fear of being contaminated with lubricating oil which must usually exist in the neighbourhood of the swash plate and the cylindrical guide members, etc.

BRIEF DESCRIPTION OF THE DRAWING

This and other objects and advantages of the present invention will be apparent from the following description and claims and are illustrated in the accompanying drawings wherein;

DESCRIPTION OF THE PREFERRED EMBODIMENT

Figure 1:
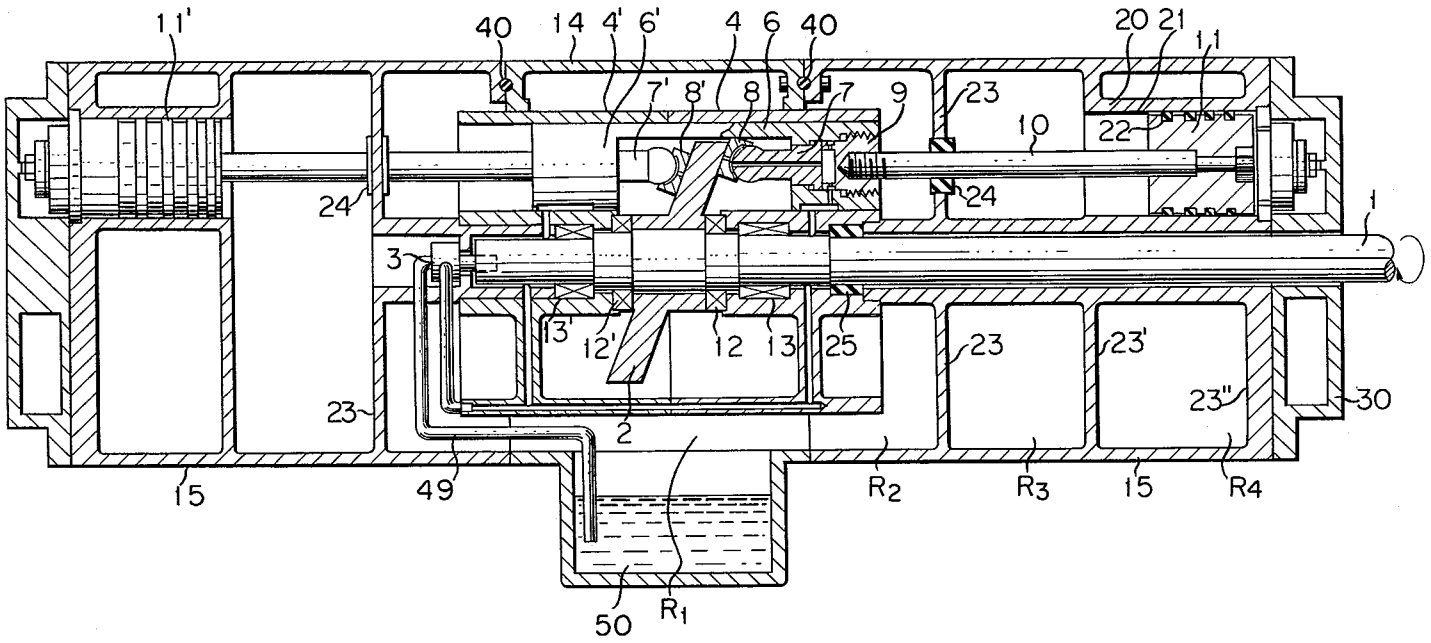
FIG. 1 shows a preferred embodiment of the present invention in longitudinal sectional view.

Referring to FIG. 1 of the drawings the reference numeral 1 shows a driving shaft of a swash plate type compressor which is adapted to be rotated by any suitable means such as an electric motor not shown and to which is fixedly secured a swash plate 2 having generally an oblique circular disc configuration. Mounted to driving shaft 1 at one end is a lubricating oil lamp pump 3. Disposed on either side of swash plate 2 are cylindrical guide blocks 4, 4', respectively, each of which has a plurality of guide cylinders disposed on a circle coaxial to the axis of the driving shaft at equi-angular intervals, whereby each of the guide cylinders belonging to respective cylindrical guide blocks 4, 4' is disposed so as to align with each other in the axial direction. Shiftably arranged within each pair of aligning guide cylinders are a pair of cylindrical guide members 6, 6' which are integrally connected with a recess being left therebetween at radially inward portions relative to drive shaft 1 for accommodating swash plate 2 therein. Each of the integrally connected cylindrical guide members 6, 6' is provided with a rod member 7, 7' so as to project axially towards the recess from its center, each of rod members 7, 7' being provided with a convex spherical portion at its free end, and a pair of bearing blocks 8, 8', each having, on one end surface, a concave spherical surface corresponding to the convex spherical portions of rod members 7, 7' and on the other end surface, a plane surface to rest on the sliding surface of either side of swash plate 2, are disposed between rod members 7, 7' and swash plate 2. Thus it will be noticed that upon rotation of swash plate 2 resulting from the rotation of drive shaft 1 respective pairs of integral cylindrical guide members 6, 6' carry out reciprocating movement within the guide cylinders of cylindrical guide blocks 4, 4' through spherical bearing blocks 8, 8' and rod members 7, 7' in parallel with the axis of drive shaft 1.

Drilled centrally from the outside surface of each of cylindrical guide members 6, 6' is a stepped through bore so as to receive the head portion of respective rod members 7, 7' each having been shaped with a corresponding stepped configuration, whereby rod members 7, 7' are fixedly secured in position by respectively screwing fastening nuts 9 from the outside into the stepped bores of cylindrical guide members 6, 6' which have been previously formed with corresponding femal screw threads. Respective piston rods 10 are fixedly screwed at one end to each of fastening nuts 9 from the outside at its center and have at the other end fixedly secured respective pistons 11, 11'.

Centrally disposed in cylindrical guide blocks 4, 4' are a pair of thrust bearings 12, 12' at either side of swash plate 2 to support driving shaft 1 for rotation and also disposed in cylindrical guide blocsk 4, 4' outwardly from thrust bearings 12, 12', are a pair of radial bearings 13, 13' to additionally share the radial load of driving shaft 1. In this point it should be supplemented that lubricating oil to be fed to bearing 12, 12'; 13, 13' and the relative rotating surfaces between both spherical surfaces of rod members 7, 7' and bearings blocks 8, 8' as well as between the plane surfaces of bearing blocks 8, 8' and swash plate 2 is forcibly supplied from lubricating oil pump 3 through appropriate oil grooves (not shown) provided in those portions.

Cylindrical guide blocks 4, 4' are housed within a frame 14, having generally a hollow cylindrical shape with an axial length somewhat shorter than the overall length of cylindrical guide blocks 4, 4', by any suitable means with an appropriate space $R_1$ being left therebetween for the purpose to be described later. Disposed axially at both ends of frame 14 are a pair of substantially symmetrical frames 15 so as to be rigidly secured together by an suitable means such as by bolts and nuts with elastic sealing means 40 interposed therebetween. Each of frames 15 is of a substantially hollow cylindrical shape with a number of hollow compartments $R_2$, $R_3$, and $R_4$ being formed by corresponding partitions 23 and 23' and an end face 23". Disposed within hollow compartment $R_4$ are a number, corresponding to the number of guide cylinders, of cylinders 20 so as to respectively align with the guide cylinders whereby each of cylinders 20 is adapted to shiftably receive piston 11, 11' and is rigidly connected at both ends to partition 23' and end face 23" of frame 15 to form cylindrical passages 21 therethrough, respectively. Further, sealingly connected to end face 23" or frame 15 is a valve block 30 having generally a flat cylindrical form which is provided with valve means having any conventional design known in the art at respective positions corresponding to the cylindrical passages 21 opened in end face 23" of frame 15. Thus, it will be appreciated that, when respective pistons 11 carry out corresponding reciprocating movements within respective cylinders 20 due to the fact of their rigid connection to the guide cylinders through piston rods 10, gas is sucked in to be delivered under pressure by the action of the valve means of valve block 30 in a manner well known in the art. Each of pistons 11 is provided with a number of piston rings 22 having self-lubricating properties so that piston 11 can compress the gas within cylinder 20 without being supplied with lubricating oil from the outside. It will be appreciated that pistons 11, 11' disposed oppositely may have identical diameters or different diameters and in the latter case a multiple compression of the gas can be effectively achieved. Further, portions in partition 23 were respective piston rods 10 pass through are provided with oil seal means 24 to scrape off the lubricating oil which is accidentally brought along piston rods 10 from the rotating or reciprocating parts contained in cylindrical guide blocks 4, 4'. Also, provided between cylindrical guide block 4 and driving shaft 1 are further oil seal means 25 to prevent lubricating oil from passing through the gap formed therebetween.

Figure 2:
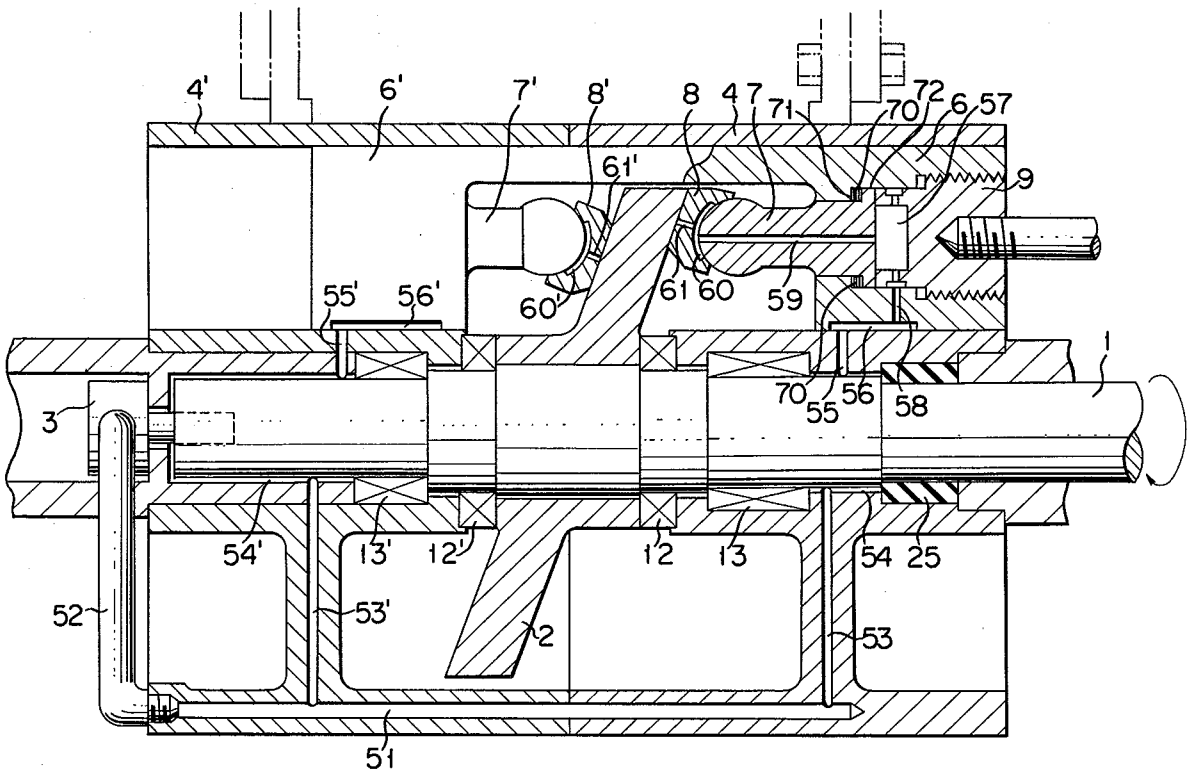
FIG. 2 shows a portion thereof in partial longitudinal sectional view to a large scale.

At this point, a preferred lubricating system for the relatively moving portions around swash plate 1 will be briefly explained in reference to FIG. 2 wherein rod members 7, 7', spherical bearing blocks 8, 8', fastening nuts 9, etc. are represented partially in section, to a larger scale together with swash plate 1, cylindrical guide blocks 4, 4' and cylindrical guide members 6, 6'.

The lubricating oil sucked via a pipe 49 from a lubricating oil reservoir 50, which is formed in the bottom of space $R_1$ of frame 14 (see FIG. 1) by lubricating oil pump 3 is fed under pressure to an oil groove 51 drilled axially in the wall of cylindrical guide blocks 4, 4'through an oil distributing pipe 52 connecting the discharge port of lubricating oil pump 3 and the open end of oil groove 51. Radial conduits 53, 53' branched from oil groove 51 are connected to lubricating oil sumps 54, 54', respectively, which are provided by the gaps formed between the outer surface of driving shaft 1 and the inner surface of the central cylindrical wall of cylindrical guide blocks 4, 4' surrounding driving shaft 1 at either side of swash plate 1. The lubricating oil accumulated in sumps 54, 54' is fed therefrom into the sliding surfaces between the respective outer surfaces of cylindrical guide members 6, 6' and the respective inner surfaces of the guide cylinders formed in cylindrical guide blocks 4, 4' through oil holes 55, 55' drilled respectively in the central walls of cylindrical guide blocks 4, 4'. For assuring the lubrication the outer surfaces of cylindrical guide members 6, 6', substantial portions are sliced off near the openings of oil holes 55, 55' in the central wall of cylindrical guide blocks 4, 4' so that axial oil grooves 56, 56' are formed therebetween. Oil grooves 56, 56' are in communication with hollow chambers 57, formed centrally in fastening nuts 9, at their rear portions through oil holes 58 which are drilled radially in the wall of cylindrical guide members 6, 6'. Lubricating oil thus fed into hollow chambers 57 through oil holes 58 is then fed into the spherical contact surfaces between the concave spherical surfaces of bearing blocks 8, 8' and convex spherical surfaces of rod members 7, 7' through oil grooves 59 which are drilled centrally through the longitudinal axes of rod members 7, 7' whereby the concave spherical surfaces of bearing blocks 8, 8' are formed with dented portions 60, 60' so as to accumulate the lubricating oil therein. Dented portions 60, 60' serve to assure a better lubrication between the spherical relative moving surfaces of bearing blocks 8, 8' and rod members 7, 7' and at the same time they accumulate more lubricating oil which is to be supplied through oil grooves 61, 61' drilled centrally bearing blocks 8, 8' into the relative sliding surfaces of swash plane 1 and the plane surfaces of bearing blocks 8, 8'. Further, thrust bearings 12, 12' and radial bearings 13, 13' supporting driving shaft 1 are also lubricated by the lubricating oil contained in oil sumps 54, 54' directly or indirectly, through the oil leaked from them through the gap formed between the outer surfaces of driving shaft 1 and the inner surfaces of the central walls of cylindrical guide blocks 4, 4'.

It will be appreciated that FIG. 2 shows in addition to the lubricating system, also that a number of shims 70 are interposed between the bottom 71 of the stepped through bore of each of cylindrical guide members 6, 6' and the under surface 72 of te enlarged portion of each of rod members 7. Shims 70 serve to finely adjust the gap between the bottoms of bearing blocks 8 and the surfaces of swash plate 2.

Having thus described the elements comprising a preferred embodiment of a swash plate type compressor according to the present invention, its operation will now be briefly described.

Upon revolution of swash plate 2 driven by drive shaft 1, cylindrical guide members 6, 6' perform a reciprocating movement guided by cylindrical guide blocks 4, 4' within the respective guide cylinders through spherical bearing blocks 8, 8' and rod members 7, 7' so that pistons 11, 11' also perform the reciprocating movement along cylindrical surfaces of cylinders 20 due to the connection of pistons 11 with corresponding cylindrical guide members 6, 6' by piston rods 10. Therefore gas can be compressed in the compressing chambers formed between the head portions of respective cylinders 20 and the inner surface of valve chamber 30 without liquid lubricating oil being supplied to the relative shifting surfaces, but with their being prevented from subjection to friction or wear due to the provision of self-lubricating rings 22 in pistons 11, 11'. In this case it will also be appreciated that, though the liquid lubricating oil is forcibly supplied from lubricating oil pump 3 to thrust bearings 12, 12', radial bearings 13, 13' as well as the relative sliding portions between cylindrical guide members 6, 6' and the guide cylinders and also between spherical surfaces of rod members 7, 7' and bearing blocks 8, 8' as well as the plane surfaces of bearing blocks 8, 8' and the sliding surfaces of swash plate 2 so that the lubricating oil can exist within hollow space $R_1$ of frame 14 surrounding cylindrical guide blocks 4, 4', it cannot enter cylinders 20 through hallow compartments $R_1$ and $R_2$ due to the fact that the possibility of the lubricating oil being conveyed along connecting rods 10 is effectively shut off by oil seal means 24 mounted in partition 23 dividing compartments $R_2$ and $R_3$. Further, the eventual leakage of the compressed gas into compartment $R_3$ can be recovered by connecting it with suction pipe lines by any suitable means such as by pipes. It will also be appreciated that since oil seal means 25 are provided between drive shaft 1 and cylindrical guide block 4 where the former passes through the latter, hollow space $R_1$ of frame 14 together with compartment $R_2$ and compartment $R_3$ are respectively perfectly isolated from the others, which results in ensuring that no lubricating oil or gas can be leaked outwards from the whole body of the compressor.

While there has been described and illustrated the preferred embodiment of the invention; it is to be understood that this is capable of variation and modification and is not, therefore, limited to the precise details set forth in the specification but includes such modifications and alterations as fall within the scope of the appended claims.

What is claimed is:

1. A swash plate type gas compressor comprising a housing enclosing swash plate means drivingly connected to a driving shaft, means for introducing gas into said housing, a plurality of cylindrical guide blocks mounted within cylindrical longitudinally extending frame means and each including first guide cylinders disposed in a circle around said driving shaft, cylindrical guide members each shiftably contained in each of said first cylinders and drivingly connected to said swash plate so as to perform a reciprocating movement with the rotation of said driving shaft, two sets of second cylinders disposed around said driving shaft, each set having substantially the same diameter and disposed, respectively, on opposite sides of said first cylinders, each said set of second cylinders corresponding in number to and axially spaced approximately the same distance from said first cylinders whereby the center lines of each said first and second sets of cylinders coincide, two sets of piston means, each set of piston means having substantially the same diameter and contained respectively in each of said sets of second cylinders for reciprocation, said sets of piston means each provided with a plurality of piston rings of a meterial having self-lubricating characteristics, two sets of piston rod means, each set of piston rod means connecting respective confronting pairs of said cylinder guide means and one set of said piston means, a first compartment formed by part of said frame means and a first transverse partition wall within which is located said first cylinders and said cylindrical guide members and further including channel means for lubrication of said first cylinders, said cylindrical guide members and said driving shaft, lubricant supply means located in said first compartment to forcibly supply lubricant through said channel means to said first cylinders, said cylindrical guide members and said driving shafts, a second compartment located adjacent said first compartment and formed by an extending part of said frame means and separated therefrom by said first partition wall through which said piston rod means passes, a second partition wall fixedly held in said second compartment to divide the same into two parts comprising a first part coextensive with said first partition wall and a second part located remote from said first partition all and having one set of said second cylinders and piston means mounted therein in tight engagement therewith, first lubricating seal means located in said first compartment surrounding said driving shaft to prevent compressed gas and lubricant from said compartments from leaking to the atmosphere, and second lubricating seal means spaced from said drive shaft and located in said first partition wall surrounding each set of said piston rod means to prevent lubricant in said first compartment from entering said second compartment, said first seal means, second seal means and said plurality of pistons rings preventing lubricant in said first compartment from entering said second compartment and gas in the second part of said second compartment from entering said first compartment, said first compartment and said first part of said second compartment being maintained at an identical pressure.

* * * * *